United States Patent [19]

Wohlgemuth

[11] Patent Number: 4,498,315

[45] Date of Patent: Feb. 12, 1985

[54] LATCH NEEDLE FOR MACHINES FOR PRODUCING KNITTED GOODS

[75] Inventor: Werner Wohlgemuth, Albstadt, Fed. Rep. of Germany

[73] Assignee: Theodor Groz & Sohne & Ernst Beckert Nadelfabrik Commandit-Gesellschaft, Albstadt, Fed. Rep. of Germany

[21] Appl. No.: 503,153

[22] PCT Filed: Oct. 6, 1982

[86] PCT No.: PCT/DE82/00197

§ 371 Date: May 16, 1983

§ 102(e) Date: May 16, 1983

[87] PCT Pub. No.: WO83/01259

PCT Pub. Date: Apr. 14, 1983

[30] Foreign Application Priority Data

Oct. 10, 1981 [DE] Fed. Rep. of Germany ..... 3140386

[51] Int. Cl.³ ..... D04B 35/04

[52] U.S. Cl. ..... 66/121

[58] Field of Search ..... 66/121

[56] References Cited

U.S. PATENT DOCUMENTS 956,318 4/1910 Egly ..... 66/121

*Primary Examiner*—Ronald Feldbaum

*Attorney, Agent, or Firm*—Frishauf, Holtz, Goodman & Woodward

[57] ABSTRACT

A latch needle for machines for producing knitted goods has a needle shank, a needle head and a latch which is pivotably supported in a latch slot.

In order to assure that even after long use the latch will close satisfactorily, and will not come to rest beside or underneath the needle head when closing, the latch spoon (8) is tilted with respect to the plane of symmetry (10) of the latch (5), pointing toward one side of the needle shank (1); the lateral distance (A) from the most extreme point (11) of the latch spoon (8) to the plane of symmetry (12) of the needle is equal to not more than half the shank thickness.

2 Claims, 5 Drawing Figures

Figure 1:
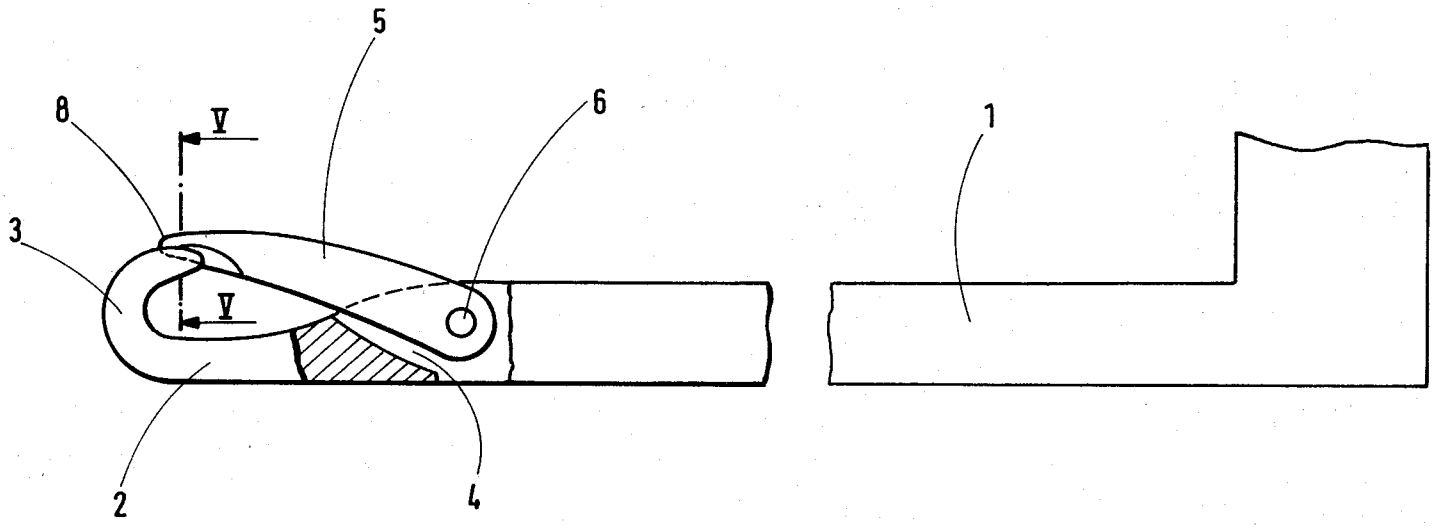

FIG. 2
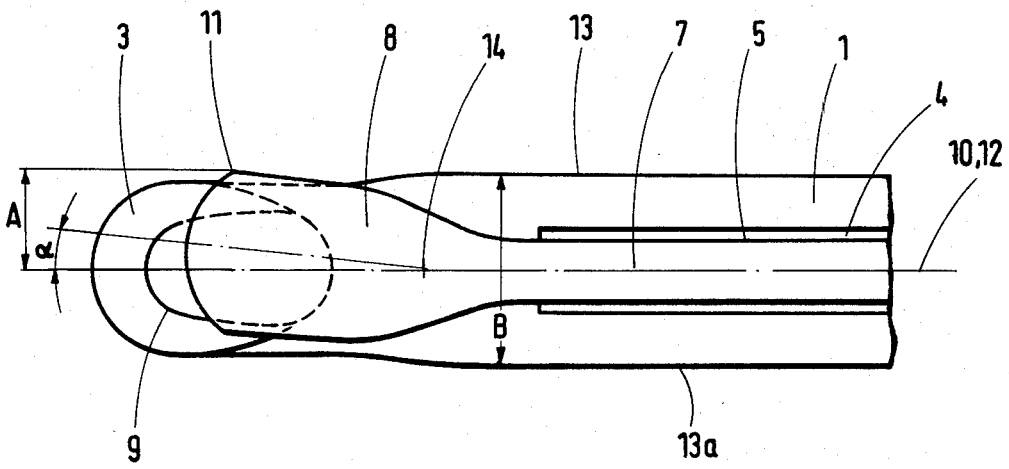
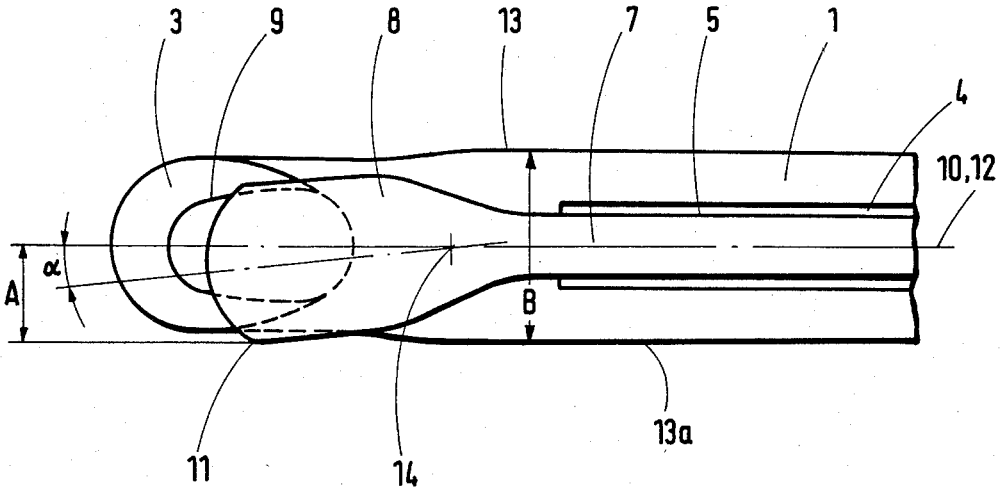
FIG. 3

FIG. 4
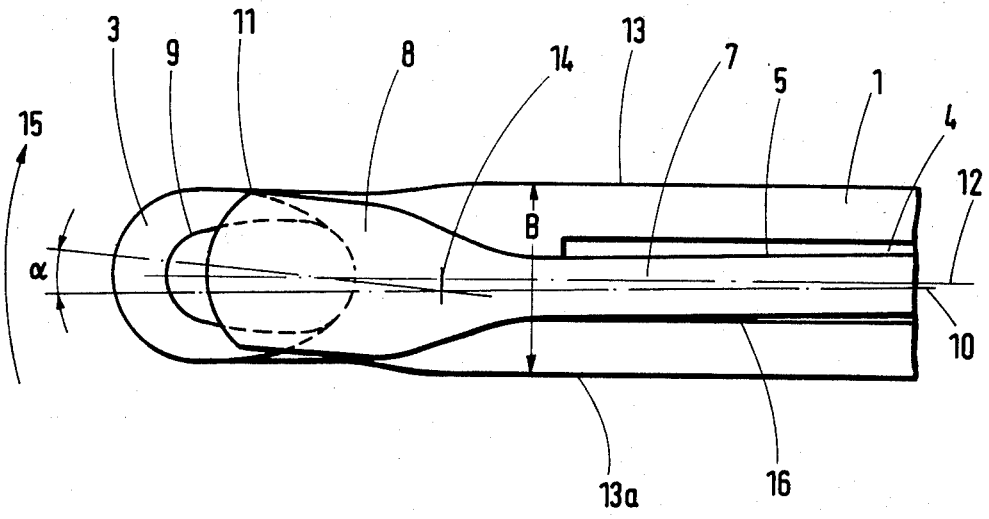
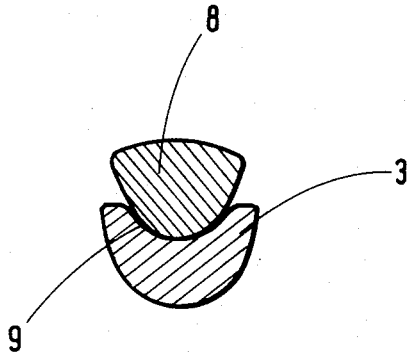
FIG. 5

LATCH NEEDLE FOR MACHINES FOR PRODUCING KNITTED GOODS

The invention relates to a latch needle for machines for producing knitted goods. The needle has a needle shank, a needle head and a latch which is pivotably supported in a latch slot.

One of the important preconditions for the satisfactory functioning of a latch needle, for instance in a knitting machine, is that the needle open and close perfectly during the knitting operation. The latch is therefore guided relatively precisely in the latch slot and is oriented with its latch spoon pointing to the tip of the hook.

In practice, however, it has been demonstrated that, particularly after being in use for a relatively long time, the latch undergoes a lateral deflection as it closes during the knitting operation, to such an extent that the latch is then beside or beneath the head of the needle. The result is that the latch is no longer capable of opening, which makes the latch needle unusable, and a flaw is created in the goods.

This undesired lateral deflection of the latch during the closing movement, which prevents the latch from coming properly to rest against the needle head, has been found to have two particular causes, which interact with one another but of themselves are entirely distinct:

In order to assure easy pivoting of the latch, the latch must have a certain amount of play both axially and radially, despite the precise embodiment of its support. A certain mobility on the part of the latch toward either side of its pivoting plane is therefore unavoidable; that is, the latch is capable of swinging or rolling somewhat to the side. Because of the length of the latch, this lateral mobility of the latch which in itself is only slight makes possible substantial lateral deflections of the free end of the latch spoon, even if only slight lateral forces are being exerted on the latch.

In a high-speed, highly systematized circular knitting machine, with a correspondingly high speed at the circumference of the needle cylinder and the dial, substantial Coriolis forces already occur during the closing and opening movements of the latch, which take place at a high rotational speed; during the closing movement of the latch, these Coriolis forces stress the latch laterally and press it against the wall of the latch slot located toward the rear, in the rotational direction of the machine. As a result, not only is the latch subjected to a lateral stress, but the rear wall of the latch slot in the direction of rotation is also subjected to increased wear. As a result of the pivoting movement of the latch, which in a conventional automatic stocking-knitting machine for producing seamless stockings opens and closes over 40 times per second, for instance, the latch and the wall of the latch slot wear each other down, which necessarily causes an increase in the lateral play of the latch guided in the latch slot. Now when the unavoidable increase in latch support play that occurs over long needle use is added, then the lateral deflection of the free end of the latch spoon can become so great, as already explained, that when the latch closes its latch spoon will miss the needle head, or will slide off to the side thereon, thus coming to rest underneath or beside the needle head and causing the latch needle to become unusable.

It is the object of the invention to overcome this problem and to create a latch needle with which it is assured that, even after a long period of use, the needle latch will close perfectly and will not come to rest beside or beneath the needle head when it closes.

In order to attain this object, the latch needle described at the outset above is characterized in accordance with the invention in that the latch spoon is tilted with respect to the plane of symmetry of the latch and points toward one end of the needle shank, and that the lateral distance between the most extreme point of the latch spoon and the plane of symmetry of the needle is at most equal to half the shank thickness.

The tilting of the latch spoon, which is adapted to the associated contact surfaces of the latch spoon and the needle head, assures that the contact of the latch spoon on the needle head is guaranteed in the closed position of the latch needle, not only when the latch needle is in a positon of rest but particularly during the knitting operation as well, when the latch is pressed by the lateral forces against the wall of the latch slot. This applies not only to latch needles fresh from the factory, in which the latch support play is still small and neither the latch slot walls nor the latch itself is worn yet, but also to latch needles in which, after a long period of use, on account of the increased latch support play and the worn latches and latch slot walls, the free end of the latch spoon is capable of executing a greater lateral deflection.

Because the lateral distance between the most extreme point of the tilted latch spoon and the plane of needle symmetry is at most equal to half the shank thickness, it is attained that the most extreme point of the latch spoon does not project beyond the associated lateral face of the needle shank. In circular knitting machines, for example, jacks may be disposed laterally beside the latch needles, and the latch needles execute a relative movement toward the jacks. The latches must be precluded from rubbing against the lateral faces of the jacks and thereby being subjected to additional wear, however, aside from the fact that they would then be pressed toward the side as well.

In the drawing, exemplary embodiments of the subject of the invention are illustrated. Shown are:

FIG. 1, a latch needle according to the invention, in a side view;

FIG. 2, the latch needle according to FIG. 1, in a plan view, on a different scale and in the form of a detail of FIG. 1, showing the position of rest of the latch needle with the latch closed;

FIG. 3, the latch needle according to FIG. 1, in a different form of embodiment and shown in a manner corresponding to FIG. 2;

FIG. 4, the latch needle according to FIG. 2, shown in a manner corresponding to FIG. 2, showing the state where the latch is pressed against one side wall of the latch slot; and FIG. 5, the latch according to FIG. 1, in a sectional view along the line V—V of FIG. 1, seen in a side view and on a different scale.

The latch needle shown in the drawing has a shank 1, which is adjoined via a throat 2 by a head 3 bent in the form of a hook. A latch slot 4 is embodied in the shank 1 and a latch 5 is supported in the slot 4 such that it can be pivoted about a needle axis 6 extending crosswise. The latch 5 has a latch shaft 7 protruding into the latch slot and also has a latch spoon 8 of greater width adjoining the shaft 7 at the end. The head 3 is grooved at 9 in the manner visible in FIG. 5, so that the correspondingly curved latch spoon 8 is capable of meshing with the groove 9.

As seen in FIGS. 2–4, the latch spoon 8 is tilted with respect to the plane of symmetry of the latch 5, which is indicated at 10, and points toward one side of the needle shank 1. The arrangement is selected such that the lateral distance A between the most extreme point 11 of the latch spoon 8 and the plane of symmetry 12 of the needle is equal to not more than half the shank thickness B. It is thereby assured that the most extreme lateral point of the latch spoon 8 will not project laterally beyond the adjacent side wall 13 or 13a of the needle shank 1.

While the latch spoon 8 is tilted in the clockwise direction in the form of embodiment shown in FIGS. 2 and 4, this tilting is effected in the counterclockwise direction in the form of embodiment shown in FIG. 3. The form of embodiment shown in FIGS. 2, 4 is accordingly intended for circular knitting machines which rotate clockwise, for instance, while the form of embodiment shown in FIG. 3 is applicable to machines which rotate in the opposite direction.

As seen in FIGS. 2–4, the latch spoon 8 is bent laterally, in the vicinity of its root at 14, about a predetermined small angle $\alpha$ with respect to the plane of symmetry 10 of the latch 5. This "bending" may be either angular or curved with a more or less large radius. In principle, it is also conceivable to shift the bending to the latch shaft 7; in that case, however, it must be assured that the bend is located in a region which will be located outside the latch slot 4 in all the positions of the latch, so that the latch will not be able to become jammed in the latch slot 4.

If the latch needle shown in FIGS. 2 is inserted into the needle cylinder of a circular knitting machine which revolves clockwise, for instance, as indicated by an arrow 15, then the latch 5 is pressed with its shaft 7 against the side wall 16, located toward the rear in the direction of rotation, of the latch slot 4 in the manner seen in FIG. 4 as a result of the lateral forces acting upon the latch 5. However, as a result of the tilting of the latch spoon 8, it is still assured that the latch spoon 8 overlaps the needle head 3 in a satisfactory manner, so that the latch spoon 8 is precluded from coming to rest beside the needle head 3 in the closed position.

The forms of embodiment of latch needles described have a grooved needle head 3, as noted. The invention is equally suitable, however, for latch needles which have a grooved latch, and the invention is entirely independent of the embodiment of the contact surface of the latch on the needle head.

I claim:

1. A latch needle for machines for producing knitted goods, having a needle shank, a needle head and a latch pivotably supported in a latch slot, characterized in that the latch spoon (8) is tilted with respect to the plane of symmetry (10) of the latch (5), pointing toward one side of the needle shank (1), and that the lateral distance (A) between the most extreme point (11) of the latch spoon (8) and the plane of symmetry (12) of the needle is equal to not more than half the shank thickness (B).

2. A latch needle as defined by claim 1, characterized in that the latch spoon (8) is laterally bent, in the vicinity of its root (at 14), about a predetermined angle ($\alpha$) with respect to the plane of symmetry (10) of the latch (5).

* * * * *